US010200795B2

(12) United States Patent
El Guindi et al.

(10) Patent No.: US 10,200,795 B2
(45) Date of Patent: Feb. 5, 2019

(54) METHOD OF OPERATING A HEARING SYSTEM FOR CONDUCTING TELEPHONE CALLS AND A CORRESPONDING HEARING SYSTEM

(71) Applicant: Sonova AG, Stafa (CH)

(72) Inventors: Nadim El Guindi, Zurich (CH); Ivo Hasler, Winterthur (CH)

(73) Assignee: SONOVA AG, Stäfa (CH)

( * ) Notice: Subject to any disclaimer, the term of this patent is extended or adjusted under 35 U.S.C. 154(b) by 55 days.

(21) Appl. No.: 15/037,764

(22) PCT Filed: Nov. 20, 2013

(86) PCT No.: PCT/EP2013/074317
§ 371 (c)(1),
(2) Date: May 19, 2016

(87) PCT Pub. No.: WO2015/074694
PCT Pub. Date: May 28, 2015

(65) Prior Publication Data

US 2016/0302015 A1 Oct. 13, 2016

(51) Int. Cl.
*H04R 25/00* (2006.01)

(52) U.S. Cl.
CPC ..... *H04R 25/43* (2013.01); *H04R 25/356* (2013.01); *H04R 25/554* (2013.01); (Continued)

(58) Field of Classification Search
CPC .... H04R 25/43; H04R 25/356; H04R 25/554; H04R 25/552; H04R 2410/05; H04R 2410/01
See application file for complete search history.

(56) References Cited

U.S. PATENT DOCUMENTS

2002/0141602 A1* 10/2002 Nemirovski ..... H04B 1/3877 381/93
2005/0195996 A1 9/2005 Dunn
(Continued)

FOREIGN PATENT DOCUMENTS

JP 2003-304599 A 10/2003
WO WO 2011137933 A1 * 11/2011 ..... H04R 25/70

OTHER PUBLICATIONS

International Search Report for PCT/EP2013/074311 dated Aug. 18, 2014.
Written Opinion for PCT/EP2013/074317 dated Aug. 18, 2014.

*Primary Examiner* — Sonia L Gay
(74) *Attorney, Agent, or Firm* — Pearne & Gordon LLP

(57) ABSTRACT

A method of operating a hearing system for conducting telephone calls as well as a hearing system capable of performing the proposed method. The hearing system includes a communication device (4) with a communication device microphone (3') for picking up a first sound signal and providing a primary sidetone signal. The hearing system further includes a hearing device with a hearing device microphone for picking up a second sound signal and providing a secondary sidetone signal. A first amplification is applied to the primary sidetone signal and a second amplification is applied to the secondary sidetone signal. Adjusting of the first amplification is dependent on adjusting of the second amplification, or alternatively, adjusting of the second amplification is dependent on adjusting of the first amplification. The primary and secondary sidetone signals are then combined and subsequently output by a hearing device loudspeaker.

16 Claims, 3 Drawing Sheets

(52) U.S. Cl.
CPC ..... *H04R 25/552* (2013.01); *H04R 2410/01* (2013.01); *H04R 2410/05* (2013.01)

(56) References Cited

U.S. PATENT DOCUMENTS

| | | | | |
|---|---|---|---|---|
| 2011/0019838 | A1* | 1/2011 | Kaulberg | G10L 21/038 381/98 |
| 2011/0137649 | A1* | 6/2011 | Rasmussen | H04R 25/356 704/231 |
| 2013/0064405 | A1 | 3/2013 | Kindred | |

* cited by examiner

METHOD OF OPERATING A HEARING SYSTEM FOR CONDUCTING TELEPHONE CALLS AND A CORRESPONDING HEARING SYSTEM

TECHNICAL FIELD

The present invention is related to a method of operating a hearing system comprising a hearing device and a communication device, the method specifically pertaining to using the hearing system for conducting telephone calls. The invention is further directed to a hearing system capable of performing the method.

BACKGROUND OF THE INVENTION

Users of miniature hearing devices such as hearing aids (also referred to as hearing prostheses or hearing instruments) for hard of hearing people or hearing enhancement devices for augmenting the hearing capability of normal hearing persons, as well as hearing protection devices designed to prevent noise-induced hearing loss, would also like to take advantage of their hearing devices when conducting telephone calls using communication devices such as a telephone. A telephone can be any type of telephone, especially a cordless telephone, a mobile telephone, or a smartphone. When conducting a telephone call the hearing device is used as a telephone headset which is wirelessly connected with for instance a mobile telephone, where the loudspeaker of the hearing device is used to provide the telephone signal from the remote participant to the ear of the user of the hearing device, and for instance the voice of the user is picked up by the microphone(s) of the hearing device and sent to the remote participant as well as to the ear of the user. In order to provide a satisfactory telephone experience the hearing device user should not only hear the voice of the remote participant when he is talking, but also be able to naturally perceive his own voice when speaking, which provides feedback allowing him to control the loudness of his own voice, as well as to hear ambient sounds in order to remain sufficiently aware of his surroundings. The feedback signal of the hearing device user's own voice from the user's voice pickup to the loudspeaker of the hearing device is referred to as sidetone signal. The sound from these different sources must be picked-up and processed appropriately before being delivered to the ear(s) of the user so that he can conduct telephone calls with ease and in a pleasant manner.

SUMMARY OF THE INVENTION

It is an object of the present invention to propose a method of operating a hearing system for conducting telephone calls providing improved feedback to the user of his own voice. This object is reached by the hearing device according to claim 1.

It is a further object of the present invention to provide a hearing system capable of performing the proposed method. Such a hearing system is specified in claim 10.

Specific embodiments of the present invention are provided in the dependent claims.

The present invention is first directed to a method for operating a hearing system comprising a hearing device with a hearing device microphone and a hearing device loudspeaker and a communication device with a communication device microphone, the method comprising the steps of:

a) picking up a first sound signal with the communication device microphone to provide a primary sidetone signal;

b) picking up a second sound signal with the hearing device microphone to provide a secondary sidetone signal;

c) sending the primary sidetone signal to a remote location via a long range wireless communication link;

d) sending the primary sidetone signal to the hearing device via a short range wireless communication link;

e) applying a first amplification to the primary sidetone signal to provide an amplified primary sidetone signal;

f) applying a second amplification to the secondary sidetone signal to provide an amplified secondary sidetone signal;

g) combining the amplified primary sidetone signal with the amplified secondary sidetone signal to provide a combined sidetone signal; and h) outputting the combined sidetone signal via the hearing device loudspeaker, wherein an adjusting of the first amplification is dependent on an adjusting of the second amplification, or alternatively, wherein an adjusting of the second amplification is dependent on an adjusting of the first amplification.

In an embodiment of the method the adjusting of the first amplification is inversely dependent on an adjusting of the second amplification, or alternatively, the adjusting of the second amplification is inversely dependent on an adjusting of the first amplification.

Due to the wireless transmission of the primary sidetone signal to the hearing device it is delayed relative to (i.e. has a higher latency than) the secondary sidetone signal and therefore combining the two sidetone signals typically produces unpleasant sound artefacts such as comb-filter effects or echoes in the combined sidetone signal. This is avoided by adjusting the amplification of the primary and secondary sidetone signals in an opposing (i.e. complementary) manner, thus yielding a pleasant sidetone signal quality to the user of the hearing system in every situation, i.e. both in quiet and noisy environments.

In a further embodiment of the method the first sound signal is picked up at the communication device by means of a (dedicated) voice pickup unit comprising multiple microphones and in particular including directional sound processing means to provide a primary sidetone signal with improved signal-to-noise ratio (SNR) in noisy environments.

In a further embodiment of the method the adjusting of the second amplification comprises increasing or decreasing the second amplification of the secondary sidetone signal and the adjusting of the first amplification comprises automatically decreasing the first amplification of the primary sidetone signal if the second amplification is increased, and automatically increasing the first amplification if the second amplification is decreased, or alternatively, wherein the adjusting of the first amplification comprises increasing or decreasing the first amplification of the primary sidetone signal and the adjusting of the second amplification comprises automatically decreasing the second amplification of the secondary sidetone signal if the first amplification is increased, and automatically increasing the second amplification if the first amplification is decreased.

In a further embodiment of the method the communication device is a telephone, such as a cordless telephone, a mobile telephone, or a smartphone.

In a further embodiment of the method step c) comprises the steps of:

c1) sending the primary sidetone signal from the communication device to a second communication device, such as a cordless telephone, a mobile telephone, or a smartphone, via a second short range wireless communication link, for instance a Bluetooth link, and c2) sending the primary sidetone signal from the second communication device to a remote location via a long range wireless communication link.

In a further embodiment of the method a user of the hearing system performs the adjusting of either the first or alternatively of the second amplification.

In a further embodiment of the method the hearing system automatically performs the adjusting of either the first or alternatively of the second amplification.

In a further embodiment of the method automatically performing the adjusting is controlled by a classifier unit capable of determining an acoustic surround situation.

In a further embodiment of the method automatically performing the adjusting is controlled dependent on at least one of the following signal features of and/or derived from the primary sidetone signal and/or the secondary sidetone signal (or derived from additional microphones of the hearing device or communication device):

- sound pressure level;
- speech-in-noise probability;
- speech probability;
- own voice probability, for instance estimated by means of own voice detection, e.g. using speech recognition or voice activity detection;
- harmonicity;
- signal-to-noise ratio, e.g. estimated by means of modulation analysis, by means of statistical models, or by means of directional (multi-microphone) processing;
- low frequency sound pressure level;
- coherence of multiple microphone signals, e.g. as used to detect wind noise;
- ratio of sound pressure level at two frequencies, e.g. low versus high frequency or mid versus high frequency;
- estimates of environmental or room characteristics such as reverberation time or reverberation radius.

In a further embodiment of the method the first amplification is set to zero and the second amplification is set of a predetermined maximum value when a signal-to-noise ratio of the secondary and/or the primary sidetone signal is above a predetermined threshold.

The present invention is further directed to a hearing system comprising:

- a communication device with a communication device microphone for picking up a first sound signal and providing a primary sidetone signal;
- a hearing device with a hearing device microphone for picking up a second sound signal and providing a secondary sidetone signal, and with a hearing device loudspeaker;
- a first wireless transceiver configured for sending the primary sidetone signal to a remote location via a long range wireless communication link;
- a second wireless transceiver configured for sending the primary sidetone signal to the hearing device via a short range wireless communication link;
- a first amplifier for amplifying the primary sidetone signal by a first amplification to provide an amplified primary sidetone signal;
- a second amplifier for amplifying the secondary sidetone signal by a second amplification to provide an amplified secondary sidetone signal;
- a signal combining unit for combining the amplified primary sidetone signal with the amplified secondary sidetone signal to provide a combined sidetone signal at an output, which is connected to an input of the hearing device loudspeaker; and
- a sidetone control unit configured for controlling the first amplification such that the first amplification is dependent on the second amplification, or alternatively, for controlling the second amplification such that the second amplification is dependent on the first amplification.

In an embodiment of the hearing system the sidetone control unit is configured for controlling the first amplification such that the first amplification is inversely dependent on the second amplification, or alternatively, for controlling the second amplification such that the second amplification is inversely dependent on the first amplification.

In a further embodiment of the hearing system the sidetone control unit is configured such that the first amplification is automatically increased or decreased, respectively, when an adjustment is made to decrease or increase, respectively, the second amplification, or alternatively, wherein the sidetone control unit is configured such that the second amplification is automatically increased or decreased, respectively, when an adjustment is made to decrease or increase, respectively, the first amplification.

In a further embodiment of the hearing system the communication device is a telephone, such as a cordless telephone, a mobile telephone, or a smartphone.

In a further embodiment the hearing system further comprises a second communication device, such as a cordless telephone, a mobile telephone, or a smartphone, and a third wireless transceiver for sending the primary sidetone signal from the communication device to the second communication device via a second short range wireless communication link, for instance a Bluetooth link, wherein the first wireless transceiver is comprised in the second communication device for further sending the primary sidetone signal to the remote location via the long range wireless communication link.

In a further embodiment of the hearing system the first and/or the second amplification is adjustable by a user of the hearing system.

In a further embodiment the hearing system is configured to automatically adjust both the first and the second amplification.

In a further embodiment the hearing system further comprises a classifier unit configured for determining an acoustic surround situation and further configured for adjusting the first or the second amplification.

In a further embodiment of the hearing system the adjusting of the first or the second amplification is dependent on at least one of the following signal features of and/or derived from the primary sidetone signal and/or the secondary sidetone signal (or derived from additional microphones of the hearing device or communication device):

- sound pressure level;
- speech-in-noise probability;
- speech probability;
- own voice probability, for instance estimated by means of own voice detection, e.g. using speech recognition or voice activity detection;
- harmonicity;
- signal-to-noise ratio, e.g. estimated by means of modulation analysis, by means of statistical models, or by means of directional (multi-microphone) processing;
- low frequency sound pressure level;
- coherence of multiple microphone signals, e.g. as used to detect wind noise;
- ratio of sound pressure level at two frequencies, e.g. low versus high frequency or mid versus high frequency;

estimates of environmental or room characteristics such as reverberation time or reverberation radius.

In a further embodiment of the hearing system the sidetone control unit is configured such that the first amplification is set to zero and the second amplification is set of a predetermined maximum value when a signal-to-noise ratio of the secondary and/or the primary sidetone signal is above a predetermined threshold.

It is pointed out that combinations of the above-mentioned embodiments give rise to even further, more specific embodiments according to the present invention.

BRIEF DESCRIPTION OF THE DRAWINGS

The present invention is further explained below by means of non-limiting exemplary embodiments and with reference to the accompanying drawings, which show.

In the figures, like reference signs refer to like parts.

DETAILED DESCRIPTION OF THE INVENTION

Figure 1:
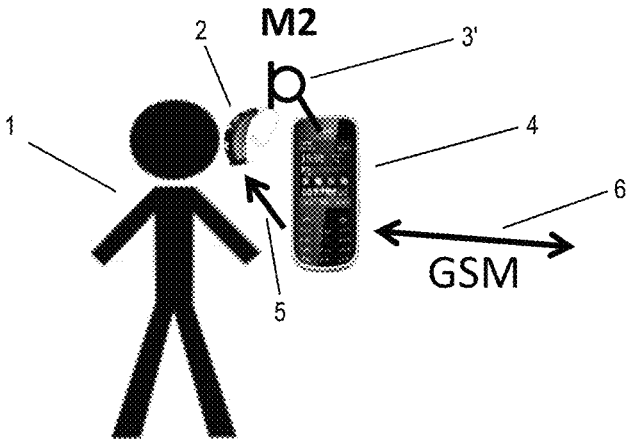
FIG. 1 a schematic representation of a hearing system being employed to conduct a telephone call in a "handset" situation.

In FIG. 1 a schematic representation of a hearing system being employed to conduct a telephone call is illustrated. The situation shown in FIG. 1 will be referred to as "handset" use case. Hereby, a user 1 wearing a hearing device 2 at an ear is holding a mobile telephone 4 in his hand close to the ear. An incoming telephone call is received for instance from a GSM network by the mobile telephone 4 via a GSM communication channel 6. The voice signal of the caller (i.e. the far-end signal) is then sent to the hearing device 2 via a short range wireless link 5, such as for instance an inductive link, where it is output via the loudspeaker (commonly also referred to as receiver) of the hearing device 2. Conversely, the voice signal of the hearing device user 1 is picked up by a microphone 3' (M2) of the mobile telephone 4. This voice signal is then sent to the remote (i.e. far-end) caller via the GSM communication channel 6. Simultaneously, the user's voice signal is also sent to the hearing device 2 via the short range wireless link 5 and output by means of the loudspeaker of the hearing device 2 in order to provide feedback to the user 1 so that he can appropriately control the loudness of his voice.

Figure 2:
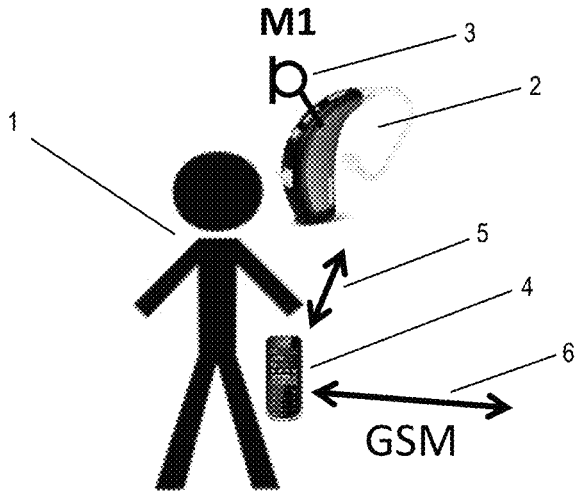
FIG. 2 another schematic representation of a hearing system being employed to conduct a telephone call in a "hands-free" situation.

In FIG. 2 a further schematic representation of a hearing system being employed to conduct a telephone call is illustrated. The situation shown in FIG. 2 will be referred to as "hands-free" use case. Here, the mobile telephone 4 is not being held close to the ear, but for instance is lying on a desk in front on the user 1 so that he can freely use both of his hands. Contrary to the "handset" use case outlined with reference to FIG. 1, the voice signal of the hearing device user 1 is now picked up by the microphone 3 (M1) of the hearing device 2. This voice signal is then sent to the remote (i.e. far-end) caller via the mobile telephone 4, i.e. using the short range wireless link 5 and the GSM communication channel 6. Again, the user's voice signal is also output via the loudspeaker of the hearing device 2 in order to provide the necessary feedback to the user 1.

Figure 3:
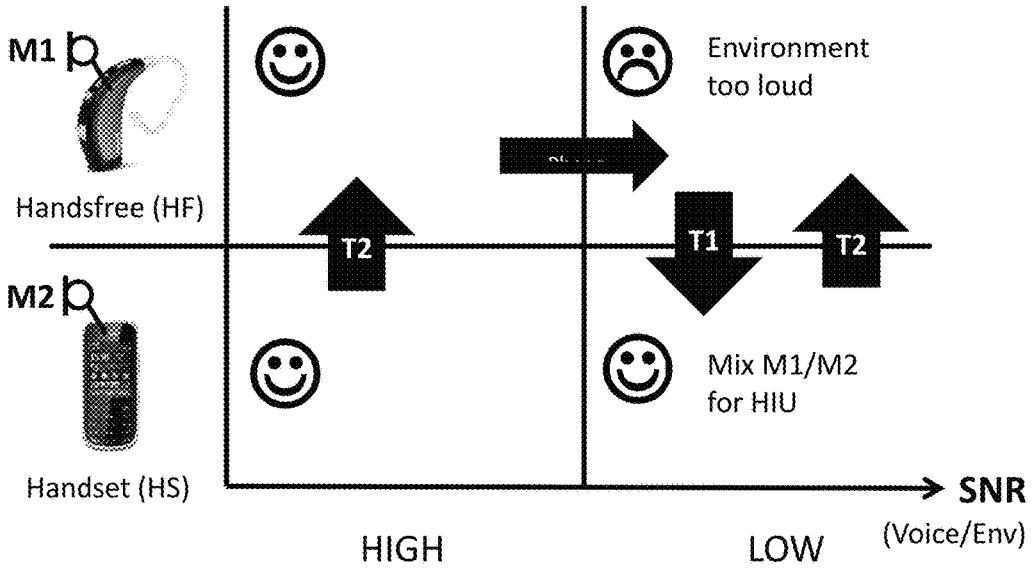
FIG. 3 matrix representation of various use-cases for a hearing system being employed to conduct a telephone call.

In the matrix representation shown in FIG. 3 various use-cases for employing a hearing system to conduct a telephone call are listed. In quiet environments (i.e. high SNR situations) where there is little ambient sound and the user's voice is dominant, the user 1 can switch from "handset" to "hands-free" operation (=transition T2), when he needs to free his hands from holding the mobile telephone 4, without experiencing any impairment of the telephone conversation. However, in loud environments (i.e. low SNR situations) the microphone M1 of the hearing device 2 will pick up too much noise, which not only makes it difficult for the remote listener to understand the user's voice but also impairs the feedback to the user 1 of his own voice. The user 1 should therefore switch from "hands-free" and "handset" operation (=transition T1), where the voice of the user 1 is picked up by the microphone 3' (M2) close to the mouth of the user 1 and preferably using a dedicated voice pickup for instance with a directional microphone (e.g. multiple microphones together with directional sound processing) in order to reduce the noise. In the "handset" use case at low SNR the feedback signal provided to the user 1, i.e. the sidetone signal is preferably a combination of a primary sidetone signal picked up by the microphone 3' (M2) of the mobile telephone 4, and thus especially comprising the voice signal of the user 1, and of a secondary sidetone signal picked up by the microphone 3 (M1) of the hearing device 2, and thus especially comprising ambient sound in order to raise awareness of the user 1 for the acoustic environment. It is now important to balance or mix these two sidetone signals in such a way that the resulting sidetone signal provides the best possible voice feedback to the user 1 over a broad range of acoustic environments (i.e. various SNRs in terms of own voice level versus sound level of the acoustic surroundings). The adjustment of the two sidetone signals lies at the core of the present invention and will be discussed next.

Figure 4:
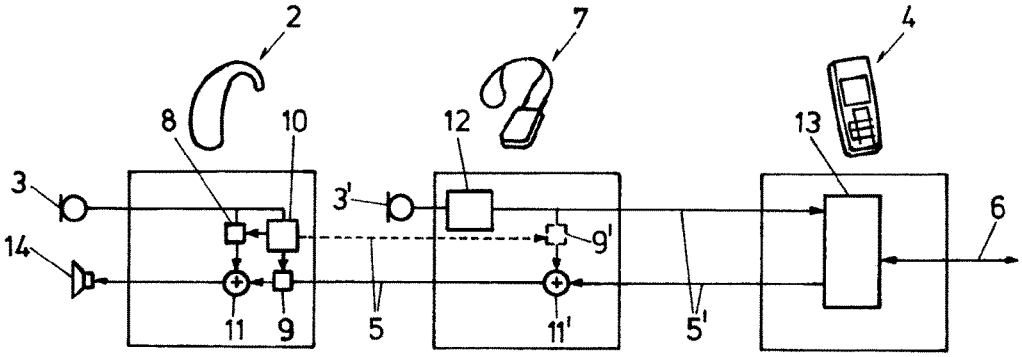
FIG. 4 a block diagram of a hearing system according to an exemplary embodiment of the present invention.

FIG. 4 illustrates a block diagram of a hearing system according to an exemplary embodiment of the present invention. The hearing system comprises three devices, namely a hearing device 2, a mobile telephone 4 and an auxiliary device 7, which essentially acts as a signal relay or bridge between the hearing device 2 and the mobile telephone 4. Instead of a single hearing device 2 a pair of hearing devices may be employed in the form of a binaural fitting, i.e. one hearing device worn at each ear. The signal from a remote speaker is sent to the mobile telephone 4 for instance through a GSM network, specifically via a GSM communication channel 6. The wireless transceiver 13 of the mobile telephone 4 receives the GSM signal and subsequently sends the voice signal of the remote speaker via a Bluetooth link 5' to the auxiliary device 7. The auxiliary device then sends the voice signal to the hearing device 2 via a further short range wireless link 5, such as an inductive link as commonly used in "hearing instrument body area networks" (HIBAN). The voice signal is then output into the ear of the user via the loudspeaker 14 of the hearing device 2. The voice signal of the user 1 is primarily pickup by a dedicated voice pickup 3', e.g. a multi-microphone arrangement together with directional sound processing means 12, located at the auxiliary device 7 in order to minimise the effect of noise sources in the vicinity of the user 1. The voice signal from the dedicated voice pickup 3' is then sent to the mobile telephone 4 via the Bluetooth link 5' where the wireless transceiver 13 sends the voice signal onward to the remote listener via the long range GSM communication channel 6. The voice signal from the dedicated voice pickup 3' is furthermore sent as a primary sidetone signal from the auxiliary device 7 via the HIBAN link 5 to the hearing device 2, where it is combined with a secondary sidetone signal provided by the hearing device microphone 3, the combined sidetone signal then being output into the ear of the user 1 via the loudspeaker 14 of the hearing device 2. Depending on the acoustic environment, i.e. on the amount of noise present in the surrounding of the user 1, the user 1 can chose to increase or decrease the level of the secondary sidetone signal with the aid of the second amplifier 8. Dependent on the setting of the second amplifier 8, the sidetone control unit 10 will automatically decrease or increase the level of the primary sidetone signal by appropriately setting the value of the amplification of the first amplifier 9. The sidetone control unit 10 is configured to decrease the amplification of the first amplifier 9 if the user 1 increases the amplification of the second amplifier 8, and conversely to increase the amplification of the first amplifier 9 if the user 1 decreases the amplification of the second amplifier 8. In this way, the two amplifications will change in opposite directions to one another, i.e. are coupled such that the amplifications change in an opposing manner (e.g. inversely), thus resulting in a "complementary adjustment" of the two sidetone signals (i.e. an increase of one leads to a decrease of the other and vice-versa). The first amplifier for the primary sidetone signal can either be located in the hearing device 2 (cf. block 9) or alternatively in the auxiliary device 7 (cf. block 9'). In the latter case the control signal from the sidetone control unit 10 has to be sent to block 9' in the auxiliary device 7 via the HIBAN link 5. Instead of the user adjusting the amplification of the secondary sidetone signal, also the sidetone control unit 10 can automatically adjust the amplification of the secondary sidetone signal based on information provided by a signal classifier (not shown in FIG. 4), capable of determining the acoustic surround situation. The sidetone control unit 10 is able to automatically adjust the amplification of the secondary sidetone signal for instance based on the following quantities: sound pressure level, speech-in-noise probability, speech probability, own voice probability (for instance estimated by means of own voice detection, e.g. using speech recognition or voice activity detection), harmonicity, signal-to-noise ratio (e.g. estimated by means of modulation analysis, by means of statistical models, or by means of directional (multi-microphone) processing), low frequency sound pressure level, coherence of multiple microphone signals (e.g. as used to detect wind noise), ratio of sound pressure level at two frequencies (e.g. low versus high frequency or mid versus high frequency), or estimates of environmental or room characteristics such as reverberation time or reverberation radius.

Figure 5:
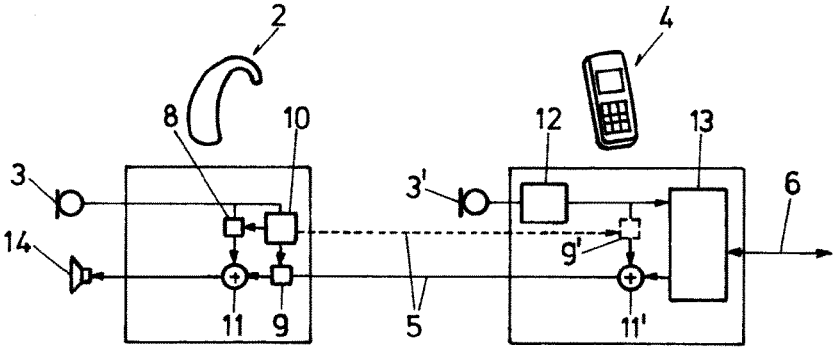
FIG. 5 another block diagram of a hearing system according to a further exemplary embodiment of the present invention.

FIG. 5 illustrates an alternative exemplary embodiment of the hearing system according to the present invention. Hereby, the hearing system merely consists of one (or two) hearing device(s) 2 and a mobile telephone 4. In this case the mobile telephone 4 is capable of directly sending signals to the hearing device 2 via the HIBAN link 5, thus obsoleting the auxiliary device 7 of FIG. 4. Otherwise, the hearing system according to FIG. 5 functions in the same way as described above.

What is claimed is:

1. A method for operating a hearing system comprising a hearing device (2) with a hearing device microphone (3) and a hearing device loudspeaker (14) and a communication device (4; 7) with a communication device microphone (3'), the method comprising the steps of:

a) picking up a first sound signal with the communication device microphone (3') to provide a primary sidetone signal;

b) picking up a second sound signal with the hearing device microphone (3) to provide a secondary sidetone signal;

c) sending the primary sidetone signal to a remote location via a long range wireless communication link (6);

d) sending the primary sidetone signal to the hearing device (2) via a short range wireless communication link (5);

e) applying a first amplification to the primary sidetone signal to provide an amplified primary sidetone signal;

f) applying a second amplification to the secondary sidetone signal to provide an amplified secondary sidetone signal;

g) combining the amplified primary sidetone signal with the amplified secondary sidetone signal to provide a combined sidetone signal; and h) outputting the combined sidetone signal via the hearing device loudspeaker (14), wherein an adjusting of the first amplification is dependent on an adjusting of the second amplification, or alternatively, wherein an adjusting of the second amplification is dependent on an adjusting of the first amplification, wherein the user (1) of the hearing system performs the adjusting of either the first or the second amplification, and wherein the hearing system automatically performs the adjusting of the other of the first and the second amplification.

2. The method of claim 1, wherein the adjusting of the second amplification comprises increasing or decreasing the second amplification of the secondary sidetone signal and the adjusting of the first amplification comprises automatically decreasing the first amplification of the primary sidetone signal if the second amplification is increased, and automatically increasing the first amplification if the second amplification decreased, or alternatively, wherein the adjusting of the first amplification comprises increasing or decreasing the first amplification of the primary sidetone signal and the adjusting of the second amplification comprises automatically decreasing the second amplification of the secondary sidetone signal if the first amplification is increased, and automatically increasing the second amplification if the first amplification is decreased.

3. The method of claim 1, wherein the communication device (4) is a telephone, such as a cordless telephone, a mobile telephone (4), or a smartphone.

4. The method of claim 1, wherein step c) comprises the steps of:

c1) sending the primary sidetone signal from the communication device (7) to a second communication device (4), such as a cordless telephone, a mobile telephone (4), or a smartphone, via a second short range wireless communication link (5'), for instance a Bluetooth link (5'), and c2) sending the primary sidetone signal from the second communication device (4) to a remote location via a long range wireless communication link (6).

5. The method of claim 1, wherein the hearing system automatically alternatively performs the adjusting of both the first and the second amplification.

6. The method of claim 5, wherein automatically performing the adjusting is performed based on a determined acoustic surround situation.

7. The method of claim 6, wherein automatically performing the adjusting is controlled dependent on at least one of the following signal features of and/or derived from the primary sidetone signal and/or the secondary sidetone signal:

sound pressure level;

speech-in-noise probability;

speech probability;

own voice probability, for instance estimated by means of own voice detection, e.g. using speech recognition or voice activity detection;

harmonicity;

signal-to-noise ratio, e.g. estimated by means of modulation analysis, by means of statistical models, or by means of directional processing;

low frequency sound pressure level;

coherence of multiple microphone signals, e.g. as used to detect wind noise;

ratio of sound pressure level at two frequencies, e.g. low versus high frequency or mid versus high frequency;

estimates of environmental or room characteristics such as reverberation time or reverberation radius.

8. A method for operating a hearing system comprising a hearing device (2) with a hearing device microphone (3) and a hearing device loudspeaker (14) and a communication device (4; 7) with a communication device microphone (3'), the method comprising the steps of:

a) picking up a first sound signal with the communication device microphone (3') to provide a primary sidetone signal;

b) picking up a second sound signal with the hearing device microphone (3) to provide a secondary sidetone signal;

c) sending the primary sidetone signal to a remote location via a long range wireless communication link (6);

d) sending the primary sidetone signal to the hearing device (2) via a short range wireless communication link (5);

e) applying a first amplification to the primary sidetone signal to provide an amplified primary sidetone signal;

f) applying a second amplification to the secondary sidetone signal to provide an amplified secondary sidetone signal;

g) combining the amplified primary sidetone signal with the amplified secondary sidetone signal to provide a combined sidetone signal; and h) outputting the combined sidetone signal via the hearing device loudspeaker (14), wherein an adjusting of the first amplification is dependent on an adjusting of the second amplification, or alternatively, wherein an adjusting of the second amplification is dependent on an adjusting of the first amplification, and wherein the first amplification is set to zero and the second amplification is set to a predetermined maximum value when a signal-to-noise ratio of the secondary and/or the primary sidetone signal is above a predetermined threshold.

9. A hearing system comprising:

a communication device (4; 7) with a communication device microphone (3') for picking up a first sound signal and providing a primary sidetone signal;

a hearing device (2) with a hearing device microphone (3) for picking up a second sound signal and providing a secondary sidetone signal, and with a hearing device loudspeaker (14);

a first wireless transceiver (13) configured for sending the primary sidetone signal to a remote location via a long range wireless communication link (6);

a second wireless transceiver configured for sending the primary sidetone signal to the hearing device via a short range wireless communication link (5);

a first amplifier (9, 9') for amplifying the primary sidetone signal by a first amplification to provide an amplified primary sidetone signal;

a second amplifier (8) for amplifying the secondary sidetone signal by a second amplification to provide an amplified secondary sidetone signal; and a signal processor (11, 11') for combining the amplified primary sidetone signal with the amplified secondary sidetone signal to provide a combined sidetone signal at an output, which is connected to an input of the hearing device loudspeaker (14), wherein the hearing device controls the first amplification such that the first amplification is dependent on the second amplification, or alternatively, controls the second amplification such that the second amplification is dependent on the first amplification, and wherein either the first or the second amplification is adjustable by the user (1) of the hearing system, and wherein the hearing system is configured to automatically adjust the other of the first and the second amplification.

10. The hearing system of claim 9, wherein the hearing device is configured such that the first amplification is automatically increased or decreased, respectively, when an adjustment is made to decrease or increase, respectively, the second amplification, or alternatively, wherein the hearing device is configured such that the second amplification is automatically increased or decreased, respectively, when an adjustment is made to decrease or increase, respectively, the first amplification.

11. The hearing system of claim 9, wherein the communication device (4) is a telephone, such as a cordless telephone, a mobile telephone (4), or a smartphone.

12. The hearing system of claim 9, further comprising a second communication device (4), such as a cordless telephone, a mobile telephone (4), or a smartphone, and a third wireless transceiver for sending the primary sidetone signal from the communication device (7) to the second communication device (4) via a second short range wireless communication link (5'), for instance a Bluetooth link (5'), wherein the first wireless transceiver (13) is comprised in the second communication device (4) for further sending the primary sidetone signal to the remote location via the long range wireless communication link (6).

13. The hearing system of claim 9, wherein the hearing system is further configured to automatically adjust both the first and the second amplification.

14. The hearing system of claim 13, wherein the hearing system is further configured to determine an acoustic surround situation and to adjust the first or the second amplification.

15. The hearing system of claim 14, wherein the adjusting of the first or the second amplification is dependent on at least one of the following signal features of and/or derived from the primary sidetone signal and/or the secondary sidetone signal:

sound pressure level;

speech-in-noise probability;

speech probability;

own voice probability, for instance estimated by means of own voice detection, e.g. using speech recognition or voice activity detection;

harmonicity;

signal-to-noise ratio, e.g. estimated by means of modulation analysis, by means of statistical models, or by means of directional processing;

low frequency sound pressure level;

coherence of multiple microphone signals, e.g. as used to detect wind noise;

ratio of sound pressure level at two frequencies, e.g. low versus high frequency or mid versus high frequency;

estimates of environmental or room characteristics such as reverberation time or reverberation radius.

16. The hearing system of claim 9, wherein the hearing device is configured such that the first amplification is set to zero and the second amplification is set to a predetermined maximum value when a signal-to-noise ratio of the secondary and/or the primary sidetone signal is above a predetermined threshold.

* * * * *